United States Patent [19]

Hauser et al.

[11] Patent Number: 4,765,836

[45] Date of Patent: Aug. 23, 1988

[54] WEAR AND CORROSION RESISTANT ARTICLES MADE FROM PM ALLOYED IRONS

[75] Inventors: John J. Hauser, Freedom; William Stasko, West Homestead; Kenneth E. Pinnow, Pittsburgh, all of Pa.

[73] Assignee: Crucible Materials Corporation, Pittsburgh, Pa.

[21] Appl. No.: 940,658

[22] Filed: Dec. 11, 1986

[51] Int. Cl.[4] ..... C22C 29/02; C22C 29/06

[52] U.S. Cl. ..... 75/241; 75/237; 75/238

[58] Field of Search ..... 75/231, 238, 239, 240, 75/241, 237

[56] References Cited

U.S. PATENT DOCUMENTS

| | | | |
|---|---|---|---|
| 4,121,927 | 10/1978 | Lohman et al. | 75/241 |
| 4,145,213 | 3/1979 | Oskarsson et al. | 75/241 |
| 4,194,910 | 3/1980 | Mal et al. | 75/239 |
| 4,249,945 | 2/1981 | Haswell et al. | 75/241 |
| 4,263,046 | 4/1981 | Fichte et al. | 75/241 |
| 4,360,383 | 11/1982 | Takahashi et al. | 75/236 |
| 4,576,642 | 3/1986 | Holtz, Jr. | 75/240 |

FOREIGN PATENT DOCUMENTS

| | | | |
|---|---|---|---|
| 60-67644 | 4/1985 | Japan | 75/241 |
| 61-64859 | 4/1986 | Japan | 75/241 |
| 2007720 | 5/1979 | United Kingdom | 75/241 |

*Primary Examiner*—Richard D. Lovering
*Assistant Examiner*—Eric Jorgensen
*Attorney, Agent, or Firm*—Finnegan, Henderson, Farabow, Garrett & Dunner

[57] ABSTRACT

A powder-metallurgy alloy article having a good combination of wear resistance and corrosion resistance. The article is further characterized by an attainable minimum hardness after heat treatment of $60R_c$ and a martensitic structure. The article is made from prealloyed particles of the composition, in percent by weight, carbon 2.5–5, manganese 0.2–1, phosphorus 0.10 maximum, sulfur 0.10 maximum, silicon 1 maximum, nickel 0.5 maximum, chromium 15–30, molybdenum, 2–10 vanadium 6–11, nitrogen 0.15 maximum and balance, iron. The article has a fine, uniform distribution of a MC and other carbide phases.

9 Claims, No Drawings

WEAR AND CORROSION RESISTANT ARTICLES MADE FROM PM ALLOYED IRONS

BACKGROUND OF THE INVENTION

For various applications such as in the mining, milling and manuring industries there is a need for an alloy characterized by a combination of high wear resistance and good corrosion resistance. Examples of products made from alloys of this type include slurry pump parts, valve components, ore and coal handling equipment, wear plates, mill liners and pulp grinders. Alloys of this type also find use in screw-feed mechanisms and the barrels used in the extrusion of abrasive glass-reinforced plastics.

With alloys of this type, it is desired to have a high content of a wear resistant phase, such as a carbide phase. Although various carbide phases are known to impart the required wear resistance, they provide the disadvantage of poor formability or fabricability with respect to operations of this type, particularly with respect to machining. Generally, the higher the carbide content, the larger will be the carbide size and thus the poorer will be the fabricating capabilities of the alloy. The corrosion resistance of alloys of this type is generally poor as a result of the absence of elements in the steel matrix for this purpose.

OBJECTS AND SUMMARY OF THE INVENTION

It is accordingly a primary object of the present invention to provide an alloy article that has a combination of high wear resistance and good corrosion resistance.

A more specific object of the invention is to provide an alloy article produced of compacted prealloyed particles which article has a fine, uniform distribution of MC and other carbides for purposes of wear resistance and an alloy matrix having corrosion resistance.

An additional object of the invention is to provide an alloy article of this type having an obtainable minimum hardness after heat treatment of $60R_c$ and a martensitic structure upon austenitizing, quenching and tempering.

In accordance with the invention, the alloy article thereof is characterized by high wear resistance and good corrosion resistance and has a martensitic structure upon austenitizing, quenching and tempering. Preferably the article has an obtainable minimum hardness after heat treatment of $60R_c$. In addition, the alloy article of the invention is made of compacted, prealloyed particles having carbon present in an amount balanced with vanadium, molybdenum, and chromium to form carbides therewith and with sufficient remaining carbon to ensure a martensitic structure. The article may be monolithic or clad with the compacted, prealloyed particles. The article has a fine, uniform distribution of MC and other carbide phases within the compacted, prealloyed particles. With respect to clad articles in accordance with the practice of the invention, the clad substrate may be of the same composition as the particles but typically will be of a different, less expensive material having lower wear and/or corrosion resistant properties. The prealloyed particles from which the article is made consist essentially of, in weight percent, carbon 2.5–5, manganese 0.2–1, phosphorus 0.10 max., sulfur 0.10 max., silicon 1 max., nickel 0.5 max., chromium 15–30, molybdenum 2–10, vanadium 6–11, nitrogen 0.15 max. and balance iron. A preferred composition consists essentially of, in weight percent, carbon 3–4, manganese 0.3–0.7, sulfur 0.02 max., silicon 0.4–0.7, chromium 22–27, molybdenum 2.75–3.25, vanadium 7.5–10, and balance iron.

The alloy article of the invention provides a combination of high wear resistance and good corrosion resistance. For this purpose, the alloy article is made by powder metallurgy techniques wherein prealloyed particles of the desired composition of the alloy article are compacted to achieve substantially full density. Compacting techniques for this purpose may include hot isostatic compacting or extrusion. Specifically, the improved wear resistance of the article results from a fine, evenly dispersed carbide formation, including MC-type carbides along with a chromium-rich carbide formation. The MC-type carbides are formed, as is well known, by a combination of carbon with the vanadium in the composition. By using the compacting of prealloyed particles, it is possible to maintain the carbides, and particularly the MC-type carbides, in a fine, even dispersion which enhances wear resistance. In this regard, and for this purpose, the prealloyed particles used in the manufacture of the article of the invention may be made by gas atomizing and rapidly cooling a melt of the alloy. In this manner, fine substantially spherical particles are achieved which are rapidly cooled to achieve solidification without sufficient time at elevated temperature for the carbides to grow and agglomerate. Consequently, the prealloyed particles are characterized by the desired fine, even carbide dispersion. By the use of conventional powder metallurgy compacting practices, this desired fine, even carbide dispersion of the prealloyed particles may be substantially maintained in the final compacted alloy article to achieve the desired combination of corrosion resistance and wear resistance.

The corrosion resistance is achieved by the relatively high chromium and molybdenum contents of the alloy, with chromium being the most significant element in this regard. In addition, sulfur is maintained at relatively low levels which also promotes corrosion resistance.

As above stated, carbon is stoichiometrically balanced with the carbide formers, namely vanadium, molybdenum and chromium, to form carbides, and adequate additional carbon is present to ensure a fully tempered martensitic structure after austenitizing, quenching and tempering. After heat treating, an obtainable hardness of at least $60R_c$ is achievable.

Vanadium is a critical element in that, with carbon, it forms the MC-type carbides that are most significant with respect to wear resistance. Wear resistance is also somewhat enhanced by the martensitic structure of the steel. Chromium is an essential element for corrosion resistance. Molybdenum is also present for this purpose and also contributes to wear resistance as a carbide former.

Although the invention has been described as an alloy article, it is to be understood that this includes the use thereof as a cladding applied to a substrate by various practices which may include hot isostatic compacting and extruding. It is necessary, however, that the cladding practice be compatible with maintaining the required carbide dispersion after cladding for achieving wear resistance. The alloy article of the invention has maximum utility in the heat treated condition but may possibly find use without heat treatment.

DETAILED DESCRIPTION AND SPECIFIC EXAMPLES OF THE INVENTION

To demonstrate the invention, alloys in accordance with the invention and conventional alloys were provided for testing. The compositions of these alloys are set forth in Table I.

TABLE I

Chemical Compositions of Experimental and Commercial Wear Resistant Alloys (percent by weight, balance iron except as indicated)

| Identity | C | Mn | Si | Cr | Mo | V | Ni | W | Other |
|---|---|---|---|---|---|---|---|---|---|
| Exp. 70 | 3.0 | 0.58 | 0.45 | 23.77 | 2.94 | 8.33 | — | — | |
| Exp. 82 | 3.27 | 0.60 | 0.58 | 23.00 | 0.05 | 8.69 | — | — | |
| Exp. 83 | 4.63 | 0.64 | 0.39 | 23.24 | 8.79 | 7.98 | — | — | |
| Exp. 94 | 3.5 | 0.58 | 0.45 | 23.77 | 2.94 | 8.33 | — | — | |
| Exp. 126 | 3.46 | 0.59 | 0.55 | 22.85 | 2.97 | 8.36 | — | — | |
| Exp. 180 | 3.6 | 0.59 | 0.55 | 23.85 | 2.97 | 8.36 | — | — | |
| Exp. 181 | 3.8 | 0.59 | 0.55 | 22.85 | 2.97 | 8.36 | — | — | |
| Exp. 182 | 4.0 | 0.59 | 0.55 | 22.85 | 2.97 | 8.36 | — | — | |
| Standard Alloy White Cast Iron (Alloy 68) | 2.5 | | | 25 | 2 | 0.5 | | | |
| Stellite 1 | 2.49 | 0.28 | 0.94 | 30.6 | 1 | | 2.17 | 13.04 | 2.28 Fe, Co Base |
| Stellite 6 | 1.13 | 0.41 | 1.06 | 28.90 | 0.27 | | 2.44 | 4.88 | 2.61 Fe, Co Base |
| CPM T-440V | 2.20 | 0.50 | 0.50 | 17.5 | 0.50 | 6.00 | — | — | |
| CPM 9V | 1.78 | 0.50 | 0.90 | 5.25 | 1.30 | 9.00 | — | — | |
| CPM 10V | 2.45 | 0.50 | 0.90 | 5.25 | 1.30 | 9.75 | — | — | |

The experimental alloys of Table I were prepared by producing pre-alloyed powder by induction melting and gas atomization. The powder was screened to −10 mesh size and placed in mild steel containers having an inside diameter of either 2 inches or 3 inches and a height of 4 inches. The powder-filled containers were outgassed in the conventional manner, heated to a temperature within the range of 2050° F. to 2185° F. and while at elevated temperature subjected to isostatic pressure of 15 ksi to fully densify the powder. Thereafter, the compacted powder and containers were cooled to ambient temperature. The alloy compacts so produced were then heated to 2100° F. and hot forged to ¼" square cross sections, which were thereafter annealed.

For evaluation, the compacts were sectioned from the forged and annealed products, rough machined, heat treated, and finish machined. Prior to machining, the compacted specimens were softened by an isothermal anneal consisting of soaking at 1800° F. or 1850° F. for one hour, heating in a furnace at 1600° F for three hours, and then air or furnace cooling. In addition, a conventional high speed steel annealing cycle was used that included heating the samples at 1600° F. for two hours, furnace cooling to 1000° F. at a rate of 25° F./hr. and then air cooling or furnace cooling to ambient temperature.

TABLE II

Hardening and Tempering Results for the Experimental Alloys

| Tempered °F./2 + 2 Hr | Rockwell C Hardness Alloy 70 | Alloy 82 | Alloy 83 | Alloy 126 | Alloy 180 | Alloy 181 | Alloy 182 |
|---|---|---|---|---|---|---|---|
| Austenitized at 1950° F./30 min. and Oil Quenched | | | | | | | |
| (Quenched only) | | | | 49.6 | 64.5 | 66.9 | 67.7 |
| 600 | | | | 49.7 | 56.2 | 64.3 | 64.8 |
| 950 | | | | 53.8 | — | 65.8 | 67.5 |
| 1000 | | | | 50.6 | 62.7 | 64.0 | 64.7 |
| 1025 | | | | 45.4 | 56.2 | 63.1 | 61.8 |
| 1050 | | | | 52.3 | 59.9 | 63.5 | 63.4 |
| 1100 | | | | 50.0 | 54.7 | 59.4 | 59.8 |
| Austenitized at 2150° F./10 min. and Oil Quenched | | | | | | | |
| (Quenched only) | | 65.3 | | 66.5 | 66.5 | 66.5 | 67.5 |
| 600 | | 64.8 | | 61.1 | 62.9 | 63.6 | 64.8 |
| 950 | | 61.8 | | 65.3 | 65.6 | 67.4 | 67.7 |
| 1000 | 40 | | 68 | 63.0 | 63.9 | 65.7 | 66.0 |
| 1025 | | | | 62.8 | 62.3 | 64.7 | 65.6 |
| 1050 | | 58.6 | | 61.6 | 62.8 | 63.5 | 65.8 |
| 1100 | | | | 58.6 | 59.3 | 60.1 | 61.7 |
| (As-Annealed) | 38 | | 58 | 41 | 44 | 46 | 47 |

During the hardening heat treatment subsequent to the above-described annealing treatment, the samples were preheated at 1500° F. and transferred to a salt bath at 2150° F. for 10 minutes, followed by oil quenching. Tempering at 1000° F. for 2+2 hours was selected as a standard practice for the wear and corrosion testing specimens based on the results of the hardness survey presented in Table II.

TABLE III

Miller Slurry Abrasive Wear and Corrosion Resistance Ratings

| Alloy | | Condition | Miller Wear Life Ratio | Corrosion Resistance Rank(1) | Hardness (Rc) |
|---|---|---|---|---|---|
| Alloy 68 White Cast Iron | (2.5C—25Cr—2Mo—0.5V) | Heat Treated | 1.00 | 4 | 61 |
| Stellite 1(2) | (2.49C—30.6Cr—1Mo—2.17Ni—13.04W—2.28Fe) | Heat Treated | 1.25 | — | 56 |
| Stellite 6(2) | (1.13C—28.9Cr—0.27Mo—2.44Ni—4.88W—2.61Fe) | Heat Treated | 0.97 | — | 45 |
| CPM 9V | (1.78C—5.25Cr—1.30Mo—9.00V) | Heat Treated | 3.3 | — | |
| CPM 10V | (2.45C—5.25Cr—1.30Mo—9.75V) | Heat Treated | 3.7 | 5 | |
| T-440V | (2.2C—17.5Cr—0.5Mo—6.0V) | Heat Treated | 1.70 | 3 | 60 |
| Experimental 70 | (3.0C—23.77Cr—2.94Mo—8.33V) | As-HIPed | 1.16 | 2 | 38 |
| Experimental 70 | (3.0C—23.77Cr—2.94Mo—8.33V) | Heat Treated | 1.21 | — | 40 |
| Experimental 82 | (3.27C—23.0Cr—0.05Mo—8.69V) | Heat Treated | 1.64 | — | 61 |
| Experimental 83 | (4.63C—23.24Cr—8.79Mo—7.98V) | As-HIPed | 2.42 | 1 | 63 |
| Experimental 83 | (4.63C—23.24Cr—8.79Mo—7.98V) | Heat Treated | 2.56 | — | 68 |
| Experimental 126 | (3.46C—22.85Cr—2.97Mo—8.36V) | Heat Treated | 2.78 | 2 | 63 |

(1)1 - Best, 5 - Poorest
(2)Co base alloys

The wear resistance of the experimental alloys in accordance with the invention were compared to each other and to a high alloyed, high-chromium white cast iron and to several conventional wear resistant iron and cobalt base alloys. The Miller slurry abrasive wear and pin abrasive wear tests were used. In the Miller wear test (ASTM G75-82) a flat alloy sample is moved back and forth under load in a slurry of wet abrasives. Wear performance is determined by the rate of metal loss.

Corrosion resistance was determined by visually inspecting the Miller Wear Test samples for rusting and corrosion and ranking the same on a scale of 1 to 5, with "1" being best and "5" being poorest from the standpoint of corrosion resistance.

The pin wear test is conducted by moving a pin of the alloy in a spiral path under load on the surface of a dry 150 mesh garnet abrasive cloth. In this test, wear resistance is rated by the amount of weight loss occuring in the alloy pin over a given period of testing time. The comparative wear resistance, expressed as a ratio of the wear rate of the standard alloy white cast iron (Alloy 68) to that of the experimental alloys in accordance with the invention, are reported in Table III. As reported in Table III, specimens with a ratio greater than one have a lower wear rate than the standard white cast iron (Alloy 68.)

Corrosion resistance rankings are also provided in Table III. In this regard, Alloy 126 has the best combination of properties with wear performance nearly three times that of the conventional white cast iron and with a corrosion resistance rating of No. 2. The CPM 10 V has the best resistance, but it also has the poorest corrosion resistance of the specimens tested. CPM 440 V has improved corrosion resistance because of its high chromium content, but is wear resistance does not equal that of CPM 10 V or the experimental alloys in accordance with the invention when in the hardened condition.

TABLE IV

Effect of Molybdenum on the Wear Test Performance of Samples Heat Treated 2150° F./10 min O.Q. + Tempered/2 + 2 hr

| Experimental Alloy | Average Pin Abrasion Wt. Loss mg | Average Miller Wear Ratio | Hardness (Rc) |
|---|---|---|---|
| 126 (3.46C—22.85Cr—2.97Mo—8.36V) HIP | 30.5 | 2.78 | 63 |
| 82 (3.27C—23.00Cr—0.05Mo—8.69V) HIP | 41 | 1.64 | 63 |
| 82 (3.27C—23.00Cr—0.05Mo—8.69V) Extruded | 48 | 1.78 | 64 |
| 82 (3.27C—23.00Cr—0.05Mo—8.69V) Extruded | 52 | — | 60 |

HIP indicates hot-isostatic pressing

Molybdenum is an essential element with respect to the alloy articles in accordance with the invention from the standpoints of both improved wear resistance and corrosion resistance. This is demonstrated by the data presented in Table IV, wherein the pin abrasion resistance of Alloy 126 containing 2.97% molybdenum was superior to that of Alloy 82 containing only residual molybdenum of 0.05%. Likewise, the Miller slurry abrasive wear ratio was higher for the molybdenum-containing Alloy 126.

It is to be noted that when molybdenum is as high as 8.79% (Alloy 83), the corrosion resistance and wear ratio is excellent. However, hot isostatically pressed compacts of this alloy fractured during hot working and cracking readily occurred during cutting. Consequently, in accordance with the invention, articles having this high molybdenum content would preferably be used in the hot isostatically pressed and heat treated condition, either as a bulk product not to be fabricated, or as a cladding. Likewise, for evaluation of the alloy effects with extrusion as a compacting practice as indicated in the tables, Alloys 82, 83 and 126 were extruded. Alloys 126 and 82 having molybdenum contents of 2.97% and 0.05%, respectively, extruded without difficulty; whereas, Alloy 83 having 8.79% molybdenum was susceptible to cracking during extrusion.

It may be seen from the above-reported experimental results that the alloy articles in accordance with the invention when processed for compaction from prealloyed powders to fully dense compacts by powder metallurgy techniques exhibit an excellent combination of wear resistance and corrosion resistance. For this purpose, it is necessary that the alloy composition have chromium, vanadium and molybdenum within the limits of the invention, and that the carbide dispersion be fine and uniform as results from the use of compacted prealloyed powders in forming the article.

What is claimed is:

1. An alloy article characterized by a good combination of wear resistance and corrosion resistance and having a martensitic structure upon austenitizing, quenching and tempering, said article comprising compacted prealloyed particles of a composition consisting essentially of, in weight percent:

carbon, 2.5 to 5
manganese 0.2 to 1
phosphorus 0.10 max.
sulfur 0.10 max.
silicon 1 max.
nickel 0.5 max.
chromium 15 to 30
molybdenum 2 to 10
vanadium 6 to 11
nitrogen 0.15 max.
iron balance, including incidental impurities, said carbon being present in an amount balanced with vanadium, molybdenum and chromium to form carbides therewith and with sufficient remaining carbon to ensure said martensitic structure with a fine, uniformly distributed MC-carbide phase.

2. The alloy article of claim 1 wherein said prealloyed particles have a composition consisting essentially of, in weight percent:

carbon 3 to 4
manganese 0.3 to 0.7
sulfur 0.02 max.
silicon 0.4 to 0.7
chromium 22 to 27
molybdenum 2.75 to 3.25
vanadium 7.5 to 10
iron balance, including incidental impurities.

3. The alloy article of claim 1 or claim 2 having an attainable minimum hardness after heat treatment of $60R_c$.

4. A monolithic alloy article in accordance with claim 2 comprising said compacted prealloyed particles.

5. A clad alloy article in accordance with claim 1 having a cladding comprising said compacted prealloyed particles.

6. A clad alloy article in accordance with claim 2 having a cladding comprising said compacted prealloyed particles.

7. The clad alloy article of claim 5 or claim 6 having an attainable minimum hardness after heat treatment of $60R_c$.

8. A monolithic alloy article in accordance with claim 1 comprising said compacted prealloyed particles.

9. The monolithic alloy article of claim 8 or claim 5 having an attainable minimum hardness after heat treatment of $60R_c$.

* * * * *